US005368653A

United States Patent [19]

Russell

[11] Patent Number: 5,368,653

[45] Date of Patent: Nov. 29, 1994

[54] PARTS WASHER FOR CLEANING MECHANICAL PARTS

[75] Inventor: Michael L. Russell, Alpharetta, Ga.

[73] Assignee: Layfield Company, Inc., Norcross, Ga.

[21] Appl. No.: 179,442

[22] Filed: Jan. 10, 1994

[51] Int. Cl.[5] ..... B08B 3/02

[52] U.S. Cl. ..... 134/24; 134/111; 134/169 A; 134/40; 134/172

[58] Field of Search ..... 134/54, 55, 104.2, 111, 134/152, 166 R, 169 A, 22.1, 22.11, 172, 40, 24; 4/639, 624, 628; 210/409, 413

[56] References Cited

U.S. PATENT DOCUMENTS

| | | | |
|---|---|---|---|
| 2,615,456 | 10/1952 | Galusha | 134/111 |
| 2,675,012 | 4/1954 | Scales | 134/111 X |
| 3,016,841 | 1/1962 | Albertson et al. | 134/111 X |
| 3,020,918 | 2/1962 | Albertson et al. | 134/111 X |
| 3,378,019 | 4/1968 | Riolo et al. | 134/111 |
| 3,522,814 | 8/1970 | Olson | 134/111 |
| 3,566,892 | 3/1971 | Louge et al. | 134/166 C |
| 3,820,552 | 6/1974 | Lang et al. | 134/169 A |
| 4,128,478 | 12/1978 | Metzger | 210/167 |
| 4,599,173 | 7/1986 | Berger | 134/169 A |
| 4,971,083 | 11/1990 | Stach et al. | 134/57 |
| 5,051,173 | 9/1991 | Hoelzl | 210/409 |

OTHER PUBLICATIONS

Johnson Industries Pro-Clean Systems Brochure.
Zep Manufacturing Company, Dyna-Clean Brochure.
Zep Manufacturing Company, DynaReclaim Brochure.
Build-All Corporation, Parts Washer Filtration Brochure.
Kleer-Flo, Cleanmaster Drum Mount Parts Washer Brochure.

*Primary Examiner*—Frankie L. Stinson
*Attorney, Agent, or Firm*—Hopkins & Thomas

[57] ABSTRACT

A parts washer (5) for cleaning mechanical parts with a liquid cleaning solvent includes a sink (7) mounted upon a reservoir (8). The sink has a bottom wall (10) in which a filter cartridge opening (20) is defined for removably receiving a filter cartridge (80) depending downwardly toward said reservoir and mounted upon said bottom wall. Pump (41) draws liquid cleaning solvent from reservoir (8) and circulates the liquid cleaning solvent into sink (7) and back into reservoir (8). Hose (50) mounted in sink (7) may be connected directly to filter cartridge (80), and pump assembly (41 ) is operated so that liquid cleaning solvent is circulated directly, under pressure, into filter cartridge (80) for clarifying and reclaiming the liquid cleaning solvent in order to maintain its cleaning efficiency and prolong its service life.

28 Claims, 5 Drawing Sheets

PARTS WASHER FOR CLEANING MECHANICAL PARTS

FIELD OF THE INVENTION

This invention relates to parts washers of the type having a sink for cleaning mechanical parts with a cleaning solvent. The cleaning solvent is circulated from a lower collection tank through a nozzle and flows freely from the nozzle into the sink as a worker rinses the parts with the cleaning solvent. The solvent drains from the sink back into the lower collection tank.

BACKGROUND OF THE INVENTION

The typical prior art parts washers are used to remove dirt, grime, etc. from the mechanical parts and comprise a sink mounted over a collection tank and a pump and conduit system to circulate the cleaning solvent from the collection tank to the nozzle of the sink. The worker cleans the parts in the sink and the cleaning liquid drains from the sink into the collection tank.

Over time, the liquid cleaning solvent used to remove dirt, grit and grease from the parts being washed will become saturated with the dirt removed from the mechanical parts and the cleaning solvent loses its effectiveness. Filters have been placed in parts washers to receive the dirty cleaning solvent draining from the sink under gravity pressure prior to passing into the collection reservoir. Also, filters have been placed in the conduit between the pump and the faucet. U. S. Pat. No. 3,378,019 to C. R. Riolo, et al. discloses a parts washer having a cylindrical filter cartridge mounted inside its reservoir below the sink, and the sink is removably mounted over the reservoir. The solvent moves through the gravity drain opening of the sink and through the filter before it returns to the reservoir. Similarly, U. S. Pat. No. 3,522,814 to Olson discloses a parts washer having a pump for moving cleaning solvent from a reservoir through a faucet which directs cleaning solvent into a sink and upon the parts to be washed, whereupon the cleaning solvent then drains by gravity through the bottom of the sink into a lower catch basin. A filter body containing waste cotton or a similar material filters the liquid cleaning solvent before it returns back to the reservoir.

U.S. Pat. No. 4,128,478 to Metzger discloses a cylindrical filter assembly in a parts washer cleaning cabinet. Metzger teaches the liquid cleaning solvent being drawn from the reservoir and passed through a cartridge filter prior to passing through a faucet to the sink.

All of the prior art devices cited above represent earlier attempts to deal with the problem of effectively cleaning the liquid cleaning solvent used in mechanical parts washers, in an attempt to improve the performance and increase the life of the cleaning solvent. There are, however, inherent drawbacks in the known prior art. For example, in both Riolo and Metzger, the filter cartridge assembly is located within the reservoir. Both require substantial disassembly of the sink from the reservoir in order to replace or clean the filter. Also, both of these filter cartridges are gravity filters, and do not receive cleaning solvent from the sink under pressure greater than atmospheric to permit high pressure filtration. Olson does not teach the use of a filter cartridge assembly, only a mass of filter material, such as cotton, disposed in a filter body.

Lastly, both Riolo and Metzger teach a parts washer in which the reservoir is located within a cabinet which supports a sink, and the sink must be removed from the cabinet in order to gain access to and remove and replace the filter cartridge. Olson presents a simpler solution to this problem in providing a sink and filter body which are mounted on a reservoir barrel, but Olson does not provide a filter cartridge for cleaning the liquid cleaning solvent.

None of the known prior art parts washers disclose a mechanical parts washer for cleaning mechanical parts and providing an easily removable filter cartridge for filtering the liquid draining from the sink as well as a means for occasionally directing the liquid cleaning solvent under greater than atmospheric pressure through the filter cartridge to clarify and prolong the life of the cleaning solvent.

SUMMARY OF THE INVENTION

Briefly described, the present invention comprises an apparatus for cleaning dirt, oil, grit, grease, and carbon from mechanical parts with a liquid cleaning solvent pumped under pressure from a reservoir through a conduit and a faucet and upon the parts to be washed in the sink, the liquid cleaning solvent then passing either through a drain in the sink directly back into the reservoir, or through a filter cartridge mounted in the bottom wall of the parts washer sink, either under gravity or under greater than atmospheric pressure, and then back to the reservoir.

The parts washer comprises a reservoir for containing liquid cleaning solvent and a sink having a bottom wall and side walls mounted over the reservoir and in communication with the reservoir so that the liquid cleaning solvent drains into the reservoir. A pump and conduit means circulate the solvent from the reservoir to a faucet mounted on the sink for directing the solvent upon parts to be washed in the sink and then back to the reservoir. The bottom sink wall of the parts washer defines an opening over the reservoir for receiving a filter cartridge. The filter cartridge is installed by being moved downwardly through the filter cartridge opening and is suspended at least partially below said sink and extends from the sink downwardly toward the reservoir. When the pump is operated to circulate the liquid cleaning solvent from the reservoir to the faucet and to the sink and then back to the reservoir, the filter cartridge will not encumber the sink. Yet, when the filter cartridge requires inspection and/or replacement, it is directly accessible without requiring disassembly of the sink from over the reservoir.

The preferred embodiment of the parts washer has a recessed flange located in the bottom wall of the sink about the periphery of the filter cartridge opening defined in the sink's bottom wall. The filter cartridge is removably received in the filter cartridge opening by inserting the filter cartridge from above the bottom wall of the sink and then downward into said filter cartridge opening toward the reservoir. The filter cartridge is constructed with an enlarged end adapted to be received upon the recessed flange in the bottom of the sink, which suspends the filter cartridge from the bottom wall of the sink, over and above the reservoir. By mounting the filter cartridge in the sink in this manner, the working space of the sink is substantially free of any encumbrance from the filter cartridge.

The parts washer may contain a plug or cap piece for placement in the filter cartridge opening of the bottom wall of the sink. If the filter cartridge has not been placed in the sink, or the filter cartridge has been mounted in the sink but it is desired to not utilize the filter cartridge, the plug may be fitted into the filter cartridge opening. The parts washer also is provided with an external filter assembly mounted externally of both the sink and the reservoir through which the solvent passes. With this arrangement the liquid cleaning solvent passes through the external filter assembly before it passes through the faucet of the sink.

In another embodiment of the parts washer, the bottom wall of the sink is not equipped with a drain in communication with the reservoir, but instead has only the filter cartridge opening defined therein. The filter cartridge has both a gravity drain which permits the liquid solvent to drain back unfiltered to the reservoir, and a filter drain which directs the solvent through the filter medium of the filter cartridge. A plug or cap is provided for permitting the liquid cleaning solvent to either drain directly by gravity back into the reservoir, or through the filter medium of the cartridge, back into the reservoir.

The filter cartridge of both the preferred and alternate embodiments is constructed and arranged so that a paper filter lining is disposed on the interior surface of the filter cartridge and retains and holds in place a powdered filter media, such as diatomaceous earth, or silicon dioxide, for clarifying and reclaiming the liquid cleaning solvent with a much higher degree of filtration available than through an external cartridge filter such as that which may be mounted upon the exterior of the parts washer.

The faucet has a nozzle hose which is long enough to connect to the filter cartridge when mounted in the bottom wall of the sink so that the solvent can be continuously recirculated by the pump through the filter. This allows for high pressure filtration of the solvent during periods when the parts washer is not otherwise in use.

Therefore, it is an object of the present invention to provide an improved parts washer for cleaning mechanical parts with a liquid cleaning solvent having a filter cartridge assembly mounted in the bottom wall of the parts washer sink, the filter cartridge being upwardly removable from the sink for easy replacement of the filter cartridge.

Another object of the present invention is to provide a parts washer for cleaning mechanical parts which provides for dual pressure filtration of the liquid cleaning solvent for greater cleaning efficiency and to prolong the life of the liquid cleaning solvent.

It is another object of the present invention to provide a parts washer in which a filter cartridge is mounted in the bottom wall of the sink so that it may be conveniently stored in the bottom wall of the sink, without encumbering the sink, and without the need for requiring any separate storage space for holding the filter cartridge until such time that it is needed to clarify or recycle the liquid cleaning solvent.

It is a further object of the present invention to provide an improved parts washer for cleaning mechanical parts which prolongs the life of the original cleaning solvent and lowers fluid replacement costs by reducing the frequency of replacing the liquid cleaning solvent.

Other objects, features, and advantages of the invention will become apparent upon reading the specification when taken in conjunction with the accompanying drawings.

DETAILED DESCRIPTION OF THE PREFERRED EMBODIMENT

Figure 1:
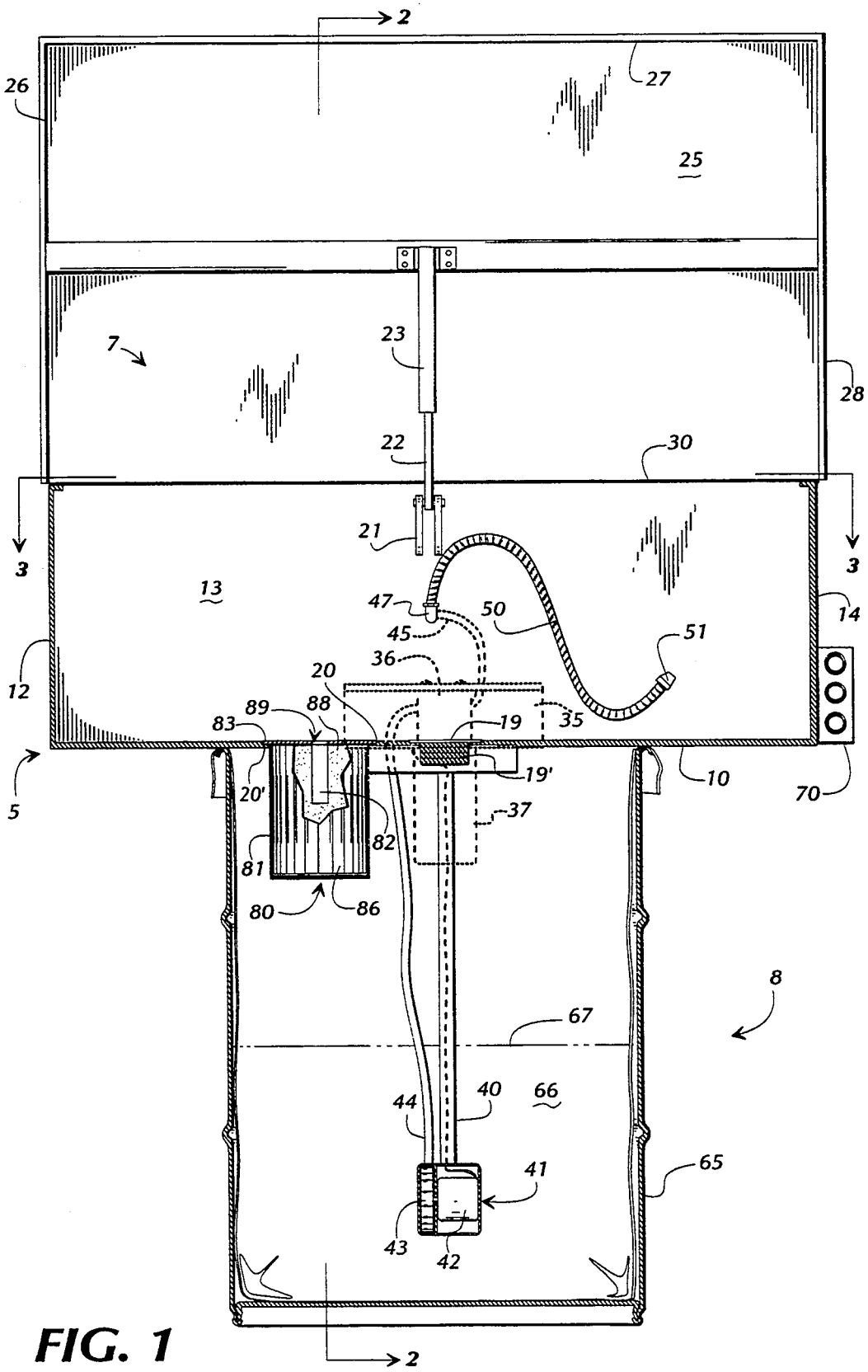
FIG. 1 is a front cross-sectional view of the preferred embodiment of the parts washer.
Figure 2:
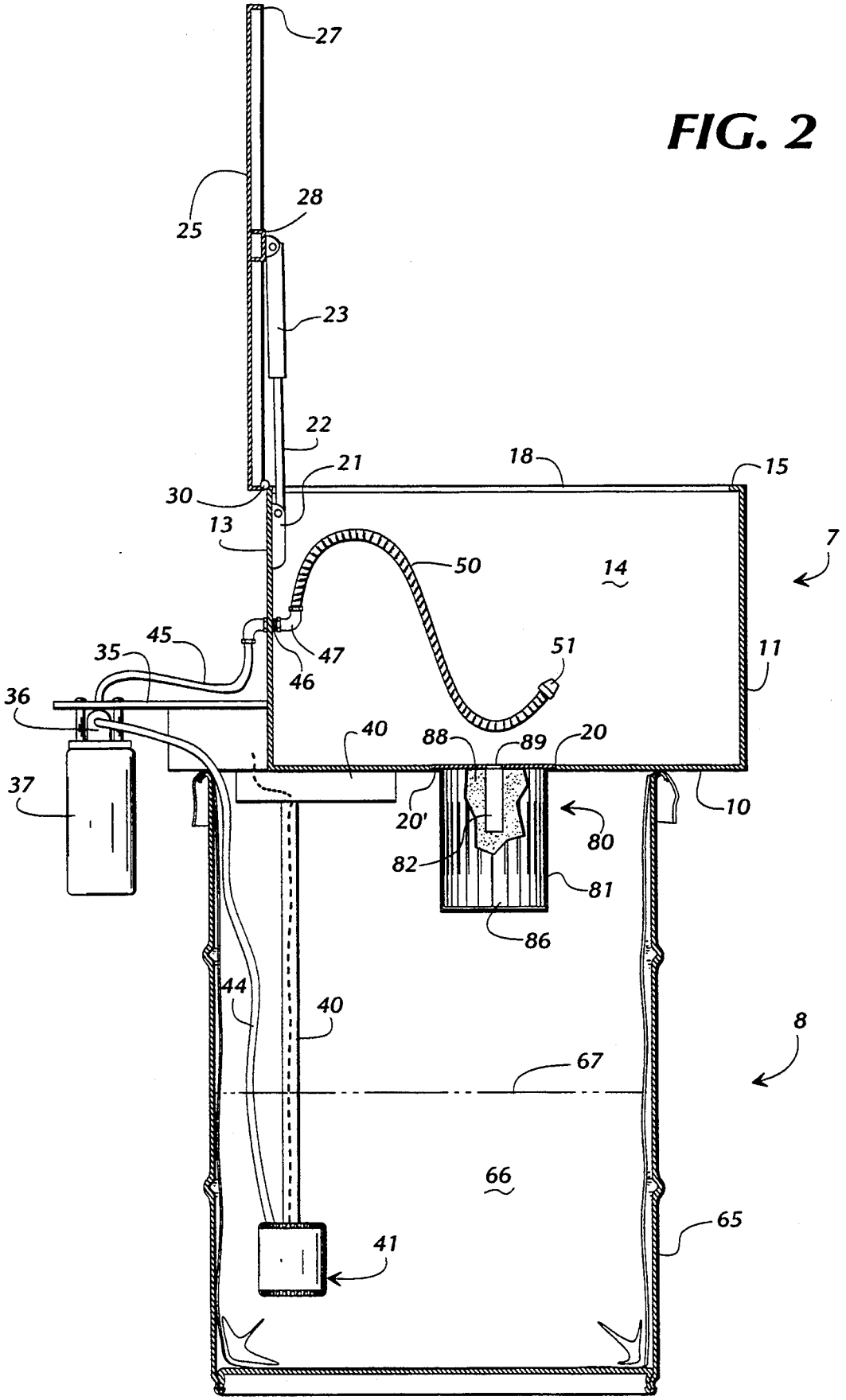
FIG. 2 is a side cross-sectional view of the embodiment of the parts washer illustrated in FIG. 1.
Figure 3:
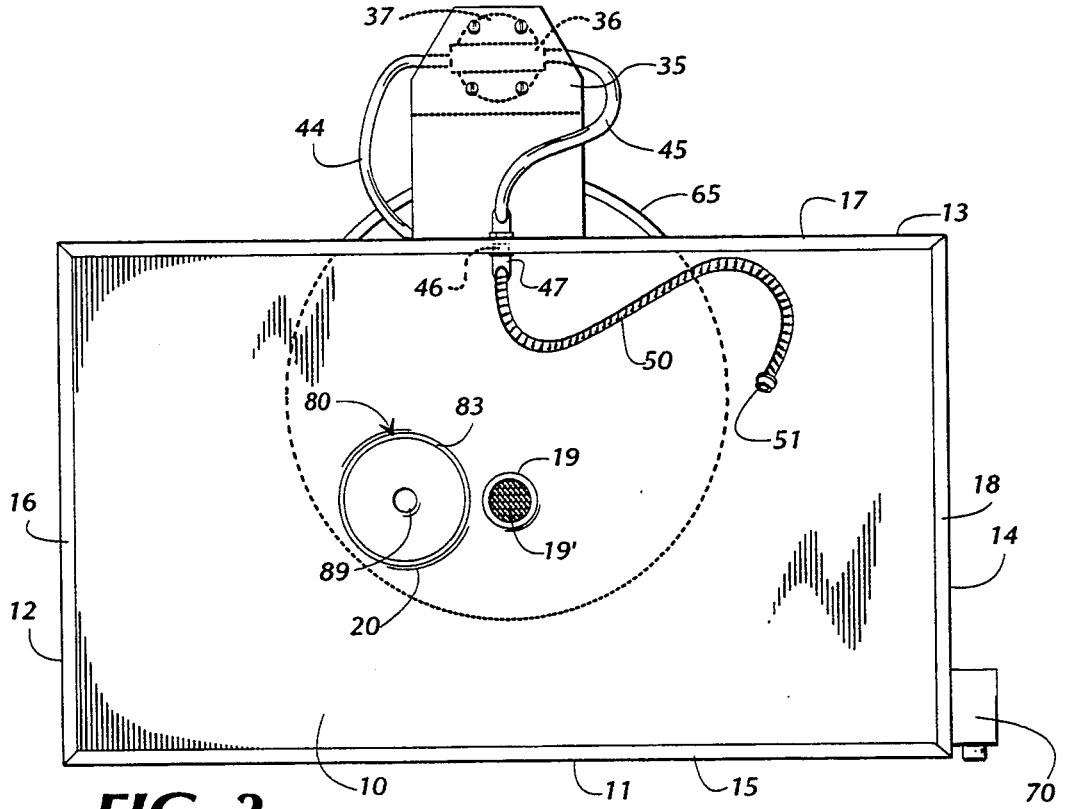
FIG. 3 is a plan view looking into the sink of the parts washer illustrated in FIG. 1.

Referring now in more detail to the drawings, in which like reference numerals indicate like parts throughout the several views, FIGS. 1 through 8 illustrate alternate versions of the present invention. FIGS. 1 through 3, illustrates the parts washer 5 which includes an open top sink 7 mounted upon reservoir 8. Sink 7 is a conventional sink which may be constructed of any conventional water tight material, and typically will be constructed of a metallic material and will be finished with either a painted or powder coated surface. Both the material and finish used on sink 7 will be impervious to the petroleum or mineral spirits based liquid cleaning solvent held within reservoir 8. The reservoir can comprise a cylindrical sixty gallon barrel 65.

As best illustrated in FIGS. 1 through 3, sink 7 comprises a rectangular bottom wall 10 supported horizontally upon reservoir 8, having four vertical walls, front wall 11, side wall 12, back wall 13, and side wall 14, all fastened to bottom wall 10 and to each other along their common edges to form a water tight sink. As shown in FIG. 3, Sink 7 also has front flange 15, side flange 16, back flange 17, and side flange 18 formed in a common plane at the upper edge of each respective wall and turned inwards at right angles to the vertical walls. Cover plate 25 is sized and shaped to rest on the upper edges of the vertical walls of the sink. Bottom wall 10 of sink 7 has a drain opening 19 defined therein for allowing the liquid cleaning solvent to drain by gravity from the sink into the reservoir 8. Bottom wall 10 also has defined therein a filter cartridge opening 20 for removably receiving filter cartridge 80 whereby liquid cleaning solvent can pass from sink 7 through filter cartridge 80 into reservoir 8. As best shown in FIG. 1, a messed mounting flange 20' is located along the periphery of filter cartridge opening 20 in the bottom wall 10 of sink 7 for supporting filter cartridge 80 when it is placed within sink 7 for use with parts washer 5.

Still referring to FIG. 1, coverplate 25 is connected to sink 7 along the top edge of back wall 13 by hinge 30. Now referring to FIGS. 1 and 2 a pair of support rod mounting flanges 21 are mounted upon the inside of back wall 13 for supporting support rod 22 and fusible link 23 which hold the cover plate 25 in an open position over sink 7, and will allow cover plate 25 to close upon sink 7 in the event a fire occurs within the sink. If a fire were to occur in the sink, fusible link 24 would melt, permitting coverplate 25 to fall by gravity down upon sink 7. Fusible link 24 is constructed in conventional fashion, and may itself comprise a chain link or spring assembly utilizing lead, or any other metallic substance having a low melting point, for the purposes of ensuring that coverplate 25 will close upon sink 7 in the event of a fire. Coverplate 25 is conventionally constructed and finished in the same material as sink 7, and is itself a rectangular plate constructed and adapted to rest upon flanges 15, 16, 17, and 18 at the top edges of the sidewalls of the sink. When coverplate 25 is closed it is held in place upon sink 7 by having a side flange 26, top flange 27, and side flange 28 formed along the side and top edges of coverplate 25. respectively, and turned perpendicularly to coverplate 25 for surrounding the upper edges of the sink.

As best illustrated in FIGS. 2 and 3, an external mounting bracket 35 is fastened to the exterior of sink 7 for supporting an external cartridge filter manifold 36, and an external cartridge filter 37 which is threadingly and sealingly received upon cartridge filter manifold 36. Cartridge filter 37 comprises a conventional automotive type filter cartridge, which is threaded upon cartridge filter manifold 36 and will typically be sealed upon cartridge filter manifold 36 through a gasket or other type of a sealing gasket or O ring (not shown). Cartridge filter 37 is constructed and adapted to filter particulates as small as 10 to 20 microns in diameter for removing particulate matter entrained within the liquid cleaning solvent.

Referring now to FIG. 2, support conduit 40 is fastened to the exterior surface of bottom wall 10 of the sink and extends downwardly into reservoir 8. The lower end of conduit 40 supports pump assembly 41 in the reservoir beneath the level of the solvent. Illustrated in FIGS. 1 and 2, support conduit 40 provides the passage through which the electric line powering pump assembly 41 is carded to pump motor 42, shown in FIG. 1, which drives a centrifugal pump 43 for drawing liquid cleaning solvent from reservoir 8 into the pump and then pumping it through conduit 44. From conduit 44 the cleaning solvent is pumped directly into sink 7 through nipple 46, passing through back wall 13, into elbow 47 and into hose 50; or through external cartridge filter manifold 36, and from cartridge filter manifold 36 the cleaning solvent then passes through conduit 45 into nipple 46 and elbow 47 into hose 50 for directing liquid cleaning solvent upon the parts to be washed within the sink. Support conduit 40 is conventionally constructed of a rigid and durable material impervious to the cleaning solvent.

Pump motor 42 is a conventional electric motor adapted for use in a liquid environment and is sealingly connected to centrifugal pump 43. Pump motor 42 operates at a constant speed so that in combination with centrifugal pump 43, a flow rate of 500 gallons of liquid cleaning solvent per hour through the parts washer is attained. It is anticipated that this will result in a system operating pressure of four to five pounds per square inch through filter cartridges 80 and 180. Conduit 44, and conduit 45, are constructed of flexible or rigid metal or plastic tubing such as neoprene or any other flexible tubing material impervious to the liquid cleaning solvent utilized in parts washer 5. Nipple 46 and elbow 47 are conventional pipe fittings.

Hose 50, illustrated in FIGS. 1 and 2, is a conventional hose adapted for use with petroleum based liquid cleaning solvents, and preferably will be a flexible self-supporting metallic hose with a neoprene lining and mounted at one of its ends on elbow 47 within sink 7. The hose 50 can be biased into any number of positions and supports itself for directing the liquid cleaning solvent used in sink 7. Nozzle 51 is sealingly attached to the distal end of hose 50, and is further sized and shaped to direct the liquid cleaning solvent used within the parts washer upon mechanical parts located in sink 7. Hose 50 is long enough and flexible enough so that its nozzle can be inserted into filter cartridge 80 when mounted in the bottom wall of the sink for passing liquid cleaning solvent under pressure from the reservoir directly through filter cartridge 80 without flowing into the sink, as discussed in greater detail below.

Reservoir 8, in FIG. 1, comprises barrel 65 constructed of conventional material resistant to the liquid cleaning solvent used within parts washer, and may also contain a barrel liner 66 constructed of a plastic material impervious to liquid cleaning solvent used within barrel 65 in order to protect the barrel from any corrosive effects of the liquid cleaning solvent. As illustrated in FIG. 1, control box 70 is mounted upon the exterior of sink 7, and houses the switch (not shown) for controlling pump assembly 41 located within reservoir 8.

As best shown in FIG. 3, sink 7 is mounted upon reservoir 8 so that drain opening 19 and filter cartridge opening 20 are in communication with reservoir 8 by being positioned directly over reservoir 8. This permits the liquid cleaning solvent used within sink 7 to drain back into reservoir 8. Drain opening 19 may contain a strainer basket 19' for collecting large particles or other large items of debris removed from the mechanical parts being washed in sink 7.

As best shown in FIGS. 1 through 3, filter cartridge 80 is inserted through filter cartridge opening 20 in bottom wall 10 of sink 7 downwardly through bottom wall 10 toward reservoir 8 until the filter cartridge 80 comes to rest upon filter mounting flange 20' disposed along the peripheral edge of filter cartridge opening 20 in bottom wall 10. A feature of mounting filter cartridge 80 in sink 7 in this fashion is that filter cartridge 80 is stored in a position where it does not encumber or otherwise interfere with parts washing operations in sink 7, and is available for immediate access when it is desired to direct liquid cleaning solvent from hose 50 and nozzle 51 directly through filter cartridge 80 into reservoir 8 for pressure recycling the liquid cleaning solvent. These operations will be discussed in greater detail, below.

Figure 6A:
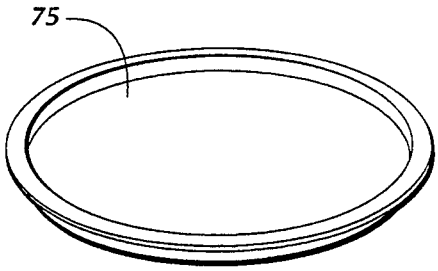
FIG. 6A is a perspective view of a filter cartridge opening plug used in the bottom wall of the sink of the parts washer.

Referring now to FIG. 6A, a filter cartridge opening plug 75 is placed in filter cartridge opening 20 of the bottom wall of the sink in the event it is desire to operate parts washer 5 without having filter cartridge 80 mounted within bottom wall 10 of sink 7. Filter cartridge opening plug 75 also is constructed so that it may be mounted in filter cartridge opening 20 even if filter cartridge 80 has been mounted in sink 7. In the embodiment illustrated in FIG. 6B, filter cartridge opening plug 175 defines therein a drain opening 176 and a removable strainer basket 177 supported therein, so that in the event the filter cartridge opening plug 175 is placed into filter cartridge opening 20 in bottom wall 10 of sink 7 when filter cartridge 80 is missing, liquid cleaning solvent drains through either drain opening 19, or drain opening 76, back to the reservoir 8. This is particularly useful with regard to use in the alternate embodiment of the invention, described in greater detail below.

Figure 5:
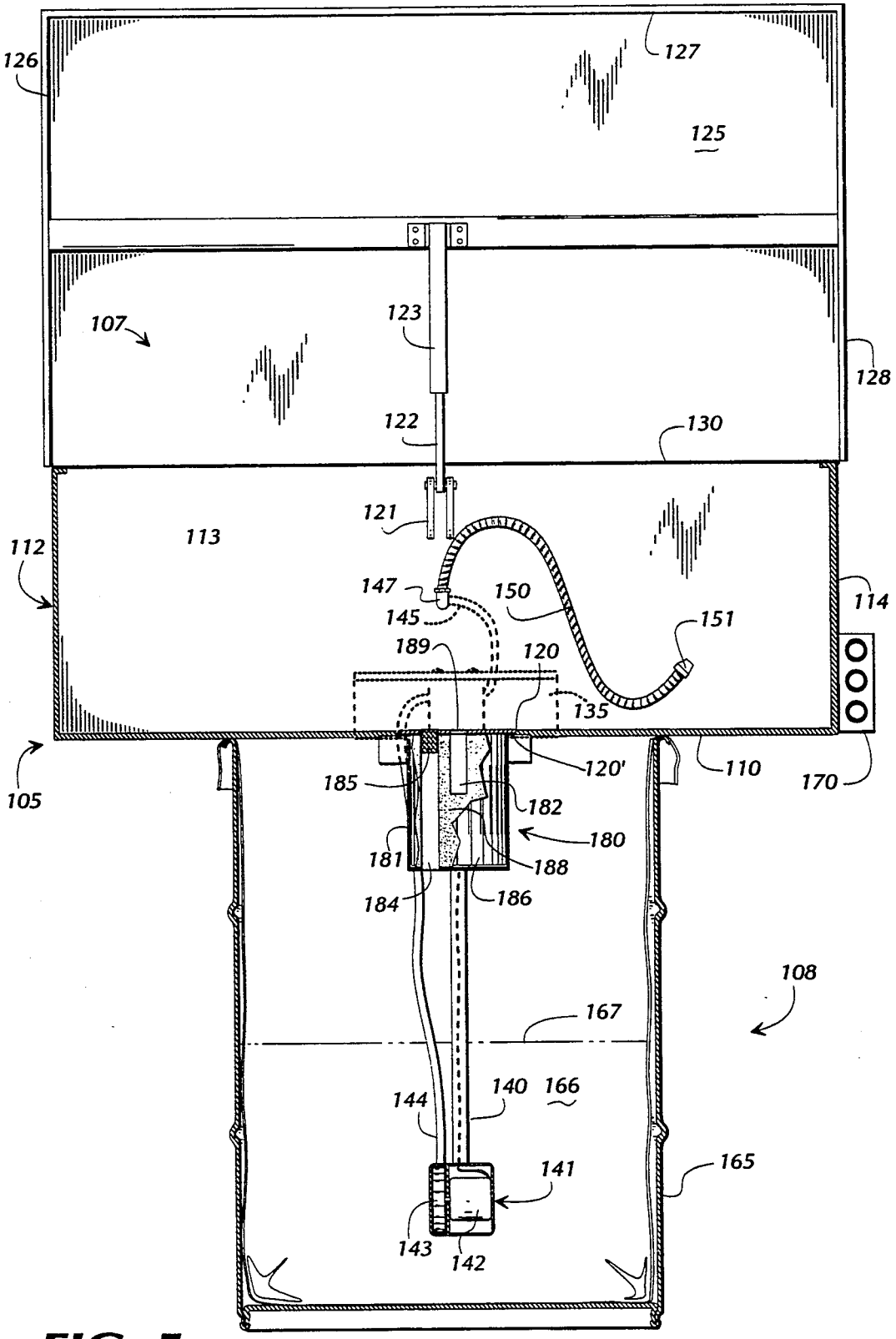
FIG. 5 is a front cross-sectional view of an alternate embodiment of the parts washer.
Figure 7:
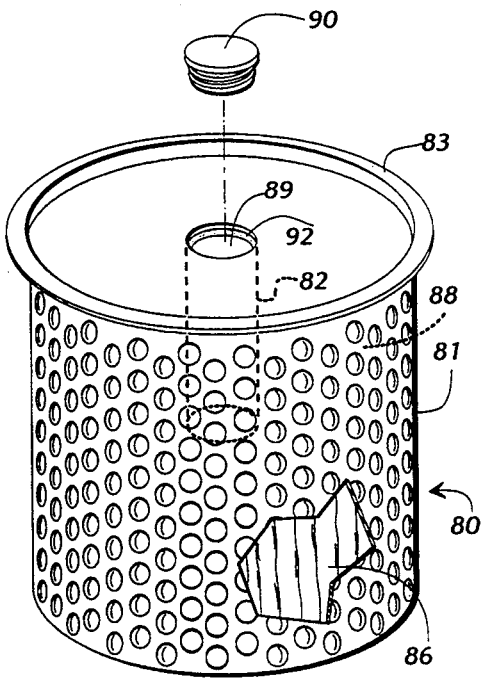
FIG. 7 is a perspective view of the filter cartridge assembly mounted in the bottom wall of the sink of the parts washer.

As shown in FIG. 7, filter cartridge 80 not only removes dirt, grit, carbon, and other entrained debris within the liquid cleaning solvent used in parts washer 5, it is also constructed to clarify or recycle the liquid cleaning solvent used in the parts washer in order to prolong the service life of the liquid cleaning solvent. This is accomplished by filter cartridge 80 having a filter body 81, with a tubular filter passage 82 defined therein for receiving liquid cleaning solvent under pressure from hose 50 and nozzle 51. As shown in FIGS. 1 and 5, filter cartridge 80 is supported within filter cartridge opening 20 by filter top flange 83 which is constructed to mate with filter mounting flange 20' located along the peripheral edge of filter cartridge opening 20 in bottom wall 10 of sink 7. Referring now to FIG. 7, filter cartridge 80 is formed of filter paper 86 located along the interior circumferential surface of filter body 81, for retaining a powdered filter media 88 through which the liquid cleaning solvent is passed after entering filter cartridge 80 by way of filter passage 82. Both filter body 81 and filter passage 82 have a plurality of openings defined therein for passing the liquid cleaning solvent into filter media 88, and through filter paper 86 into reservoir 8. Also shown in FIG. 7 is a grommet 87 located in the top of filter passage 82 for sealingly receiving nozzle 51 of hose 50 when it is desired to pass the liquid cleaning solvent directly through filter cartridge 80 for clarifying the liquid cleaning solvent. The powdered filter media 88 used in filter cartridge 80 is diatomaceous earth, also known as silicon dioxide, which has the effect of removing entrained dirt, carbon, oil, and other debris carried by the liquid cleaning solvent to a much higher degree than is available through cartridge filter 37. Accordingly, use of filter cartridge 80 will greatly prolong the life of the liquid cleaning solvent used in the parts washer. Diatomaceous earth of the type intended for use within filter cartridge 80 is available from Eagle-Picher Minerals, Inc. and is identified as Celatom FW-10, FW-12, FW-14, FW-18 and FW-20.

Still referring to FIG. 7, plug 90 is sized and shaped to be sealingly received and used to close filter passage 82 in the bottom wall 10 of sink 7. Plug 90 may be a threaded cap, or any other conventional means for sealing filter passage 82. When it is desired to draw liquid cleaning solvent from reservoir 8 into sink 7 without passing the liquid cleaning solvent through filter passage 82, plug 90 is placed in the inlet of filter passage 82 so that the liquid cleaning solvent will not be permitted to enter filter cartridge 80.

In operation, the parts to be washed within parts washer 5 will be placed within the open top of sink 7. Thereafter, an on/off switch located in control box 70 mounted upon the exterior of sink 7 will be turned on so that pump assembly 41 will draw liquid cleaning solvent from barrel 65 and force the liquid cleaning solvent up through conduit 44 into cartridge filter manifold 36 and thus through cartridge filter 37, and then through conduit 45, through nipple 46 and elbow 47 and hose 50. whereupon hose 50 will be controlled by the operator to direct a stream of liquid cleaning solvent upon the part or parts to be washed. The liquid cleaning solvent will then pass through drain opening 19 located in bottom wall 10 of sink 7 into reservoir 8 where it will be drawn once again by pump assembly 41 for use in the parts washer. When it is decided that the liquid cleaning solvent needs to be clarified, which the operator will be able to determine through the discoloration of the liquid cleaning solvent, the operator will connect the nozzle of the flexible hose to the filter cartridge 80 mounted in the opening of the bottom wall of the sink and turn on pump assembly 41. This moves the liquid cleaning solvent through conduit 44, cartridge filter manifold 36 and cartridge filter 37, and conduit 45 through hose 50 and nozzle 51 directly into filter cartridge 80 through filter passage 82, whereupon the liquid cleaning solvent will pass under greater than atmospheric pressure through the powdered filter media 88 contained within filter cartridge 80.

Figure 4:
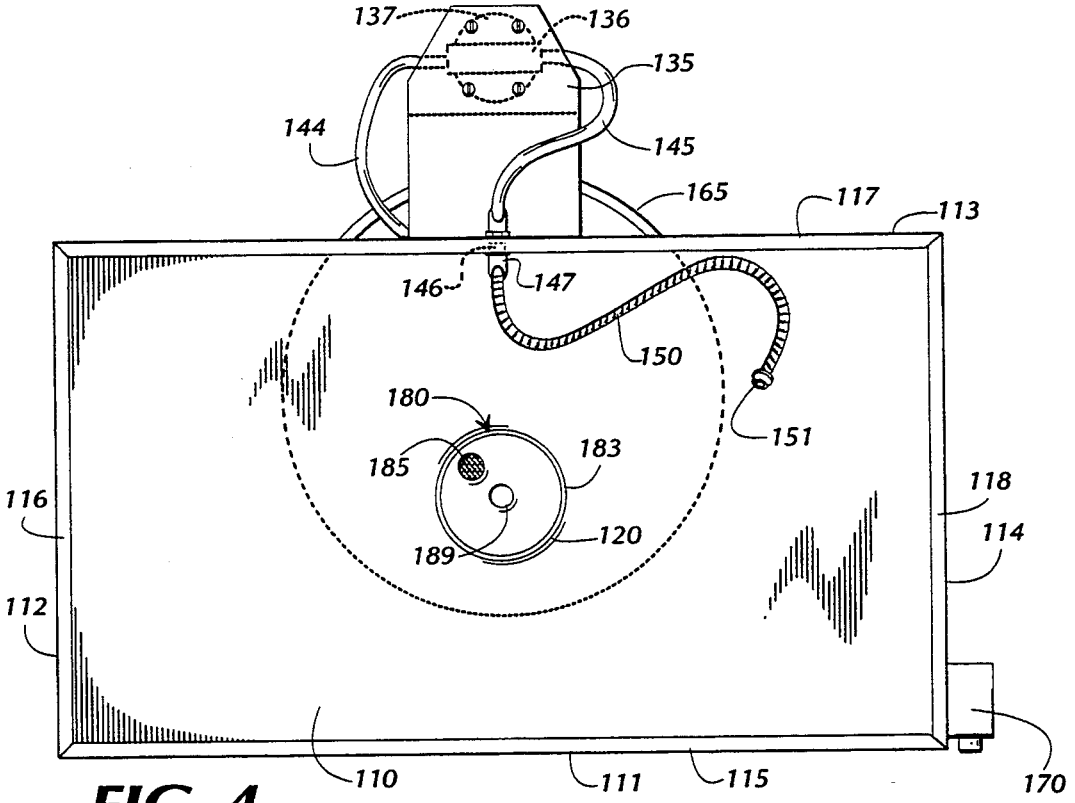
FIG. 4 is a plan view looking into the sink of an alternate embodiment of the parts washer.

Referring now to FIGS. 4 and 5, an alternate version of the invention is illustrated. As shown in FIGS. 4 and 5, in the alternate embodiment there is no drain opening but only a filter cartridge opening 120 defined within the bottom wall 110 of sink 107 for removably receiving a filter cartridge 180. An alternate version of filter cartridge 180 is disclosed in FIG. 8, in which filter cartridge 180 contains not only a filter passage 182, but also a drain passage 184 through which liquid cleaning solvent passes from the sink to the reservoir without being filtered. Drain passage 184 in filter cartridge 180 is a solid tube, and may be equipped with a strainer basket 185 for trapping large particulate matter cleansed from the parts being washed within sink 107. As further illustrated in FIG. 8, filter passage plug 190 and drain passage plug 191 are available for plugging either or both of the respective passages in filter cartridge 180 dependent upon the use intended by the parts washer operator.

Figure 8:
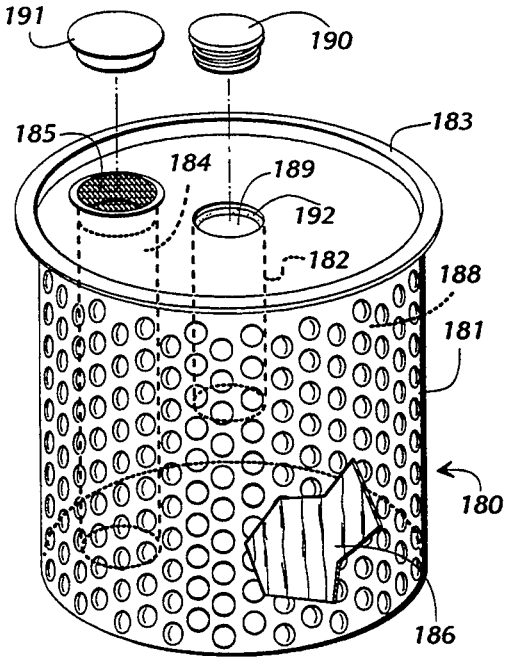
FIG. 8 is a perspective view of an alternate version of the filter cartridge utilized in the sink bottom wall of an alternate version of the parts washer.

In operation of the parts washer 105 illustrated in FIGS. 4, 5 and 8, liquid cleaning solvent is drawn from reservoir 108 through pump assembly 141 into and through conduit 144 into sink 107 through nipple 146 and elbow 147 into hose 150, or through cartridge filter manifold 136, if so provided, and then through conduit 145, nipple 146, and elbow 147 to hose 150. The liquid cleaning solvent is directed to the mechanical parts to be washed within sink 107 through hose 150. Thereafter the liquid cleaning solvent may then pass through filter passage 184 in filter cartridge 180, with large dirt and debris being captured by strainer basket 185, and/or may pass through filter passage 182, either by gravity or under greater than atmospheric pressure directly from hose 150 and nozzle 151, so that the liquid cleaning solvent is filtered prior to its return to reservoir 108. It is intended that in normal operation of the alternate version of the parts washer the liquid cleaning solvent will flow directly back to reservoir 108 through drain passage 184. When the liquid cleaning solvent is to be clarified, it will be pumped directly into filter cartridge 180 through filter passage 182 from hose 150 and nozzle 15 1 sealingly engaged upon grommet 187 at the entrance to filter passage 182, whereupon the liquid cleaning solvent will be forced under pressure through the diatomaceous earth and filter paper prior to its return to the reservoir, thereby recycling and reclaiming the liquid cleaning solvent, and thus prolonging its service life.

Figure 6B:
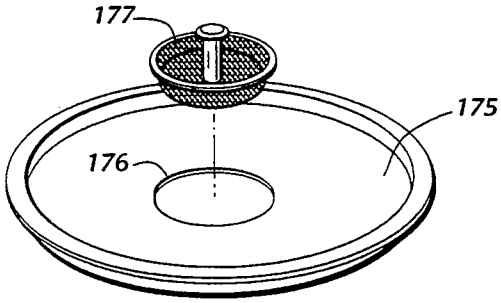
FIG. 6B is a perspective view of an alternate version of a filter cartridge opening plug used in the bottom wall of the parts washer sink.

It is anticipated that in the alternate version of the parts washer illustrated in FIGS. 4 and 5, filter cartridge 180 may be removed and the alternate version of the filter cartridge opening plug 175, illustrated in FIG. 6B, will be fitted into filter cartridge opening 120 in bottom wall 110 of sink 107. In this configuration, drain opening 176 and strainer basket 177 would be used in conjunction with filter cartridge opening plug 175 for passing the liquid cleaning solvent back to the reservoir without the use of a filter cartridge in filter cartridge opening 120.

A feature of the alternate version of the parts washer shown in FIGS. 4 and 5 is that both a smaller sink 107 and barrel 165 can be used to construct parts washer 105 because only one opening, filter cartridge opening 120, need exist in bottom wall 110 of sink 107.

Referring now to the embodiment illustrated in FIGS. 1 through 3, drain opening 19 may be sized and shaped to receive a plug, not shown, and thus only filter cartridge 80 mounted in filter cartridge opening 20, using the filter cartridge 180 illustrated in FIG. 8, would be used. This option greatly enhances the flexibility of the parts washer system dependent upon the needs and uses of the consumers who place parts washer 5 into operation.

Thus, it can be seen that the present invention comprises a useful and effective apparatus for washing mechanical parts with a liquid cleaning solvent adapted to a number of uses. While the invention has been shown and described as what is presently believed to be the most practical and preferred embodiments thereof, it will be apparent that modifications and variations within the scope and spirit of the invention are possible, and that the invention is to be afforded the interpretation so as to encompass all of the equivalents thereof, as set forth in the following claims.

We claim:

1. A parts washer for cleaning mechanical parts with a liquid cleaning solvent, comprising:

a reservoir for containing liquid cleaning solvent;

a sink having a bottom wall and side wall means mounted over said reservoir for draining liquid solvent to said reservoir;

faucet means mounted on said sink for directing liquid solvent from said reservoir to said sink;

pump and conduit means for moving liquid solvent from said reservoir to said faucet means and into said sink and back to said reservoir;

said sink defining a filter cartridge opening in said bottom wall and over said reservoir for receiving a filter cartridge downwardly therethrough and for suspending the filter cartridge at least partially below said sink and extending from said sink toward said reservoir;

said faucet means including a flexible hose of a length sufficient so that its distal end can connect directly to the filter cartridge mounted in the filter cartridge opening;

so that a filter cartridge can be placed in the filter cartridge opening, the flexible hose connected to the filter cartridge, and the pump operated to circulate liquid cleaning solvent from the reservoir to the faucet and into the filter cartridge and back to the reservoir for cleaning the liquid solvent in the filter cartridge.

2. The parts washer of claim 1 and wherein said sink includes mounting means for maintaining the filter cartridge at a position which is at least partially below the bottom wall of said sink.

3. The parts washer of claim 1 and wherein said filter cartridge opening is of a breadth sufficient to receive said filter cartridge from above the bottom wall of said sink by moving the filter cartridge downwardly at least partially through the filter cartridge opening.

4. The parts washer of claim 1 and wherein said sink is mounted on said reservoir, and wherein said sink includes mounting means for maintaining said filter cartridge at said filter cartridge opening and suspended downwardly from said sink into said reservoir so that the sink is substantially free of encumbrance from the filter cartridge.

5. The parts washer of claim 4, wherein said mounting means further comprises recessed flange means disposed along the peripheral edge of said filter cartridge opening parallel to said bottom wall.

6. The parts washer of claim 4 and wherein said filter cartridge has an end wall means of a size larger than the breadth of the rest of the filter cartridge to engage and support the filter cartridge upon the bottom wall of said sink about the filter cartridge opening.

7. The parts washer of claim 6, wherein said filter cartridge end wall means further comprises flange means disposed along the peripheral edge of said end wall means.

8. The parts washer of claim 1 and further including an external filter housing mounted externally of said sink and said reservoir, and wherein said pump and conduit means includes means for directing liquid solvent from said pump through said external filter housing and to said faucet means, so that a cartridge filter can be placed in the external filter housing and the liquid solvent moved through and cleaned by the filter cartridge in the external filter housing.

9. The parts washer of claim 1 and further including stopper means for plugging the inlet of the filter cartridge received in the filter cartridge opening to block liquid solvent from moving through the filter cartridge.

10. The parts washer of claim 1 and further including means for plugging said filter cartridge opening in the bottom wall of said sink when no filter cartridge is placed in the filter cartridge opening so that the parts washer can be used to clean parts without a filter cartridge positioned in said filter cartridge opening.

11. The parts washer of claim 1 and further including means for plugging said filter cartridge opening with the filter cartridge positioned at said opening.

12. The parts washer of claim 1 and wherein the bottom wall of said sink further includes a drain opening in communication with said reservoir, so that liquid solvent can drain from the sink into the reservoir.

13. The parts washer of claim 12, further comprising a strainer basket supported within said drain opening.

14. The parts washer of claim 13, wherein said strainer basket is upwardly removable from said drain opening.

15. The parts washer of claim 1 and further including a filter cartridge defining a drain passage having an inlet and an outlet extending therethrough and a filter passage having an inlet and an outlet extending therethrough, so that the liquid cleaning solvent can pass directly through the drain passage without filtration of the liquid cleaning solvent and can pass through the filter passage with filtration of the liquid cleaning solvent, and means for plugging at least one inlet of said drain passage and said filter passage.

16. The parts washer of claim 15, wherein said filter cartridge further comprises filter media disposed within said filter cartridge for filtration of the liquid cleaning solvent passed through the filter passage inlet of said filter cartridge.

17. The parts washer of claim 16, wherein said Filter media further comprises a filter paper disposed within said Filter cartridge adapted and constructed to retain a powdered filter media therein.

18. The parts washer of claim 17, wherein said powdered filter media further comprises diatomaceous earth.

19. In a parts washer for cleaning mechanical parts with a liquid cleaning solvent, comprising a reservoir for storing liquid solvent, a sink having a bottom wall and side wall means with a drain in communication with said reservoir, said sink being mounted over said reservoir, a faucet mounted on said sink for delivering solvent to said sink, and pump and conduit means for moving solvent from said reservoir to said faucet, the improvement therein comprising:

a filter cartridge opening in the bottom wall of said sink;

filter cartridge mounting means for mounting a solvent filter cartridge having an inlet and an outlet on said sink with the solvent filter cartridge suspended downwardly through said opening from said sink into said reservoir so that the solvent filter cartridge can be withdrawn upwardly through the bottom wall of said sink, said faucet including a self-supporting flexible hose of a length sufficient to connect to the inlet of said filter cartridge mounted in said filter cartridge opening, and wherein the liquid solvent is moved by the pump and conduit means from the reservoir through said faucet to the sink and then through the drain back to the reservoir for cleaning parts, or the hose is connected to the filter cartridge and the liquid solvent is moved by the pump and conduit means from the reservoir and through the filter cartridge inlet back to the reservoir for cleaning the liquid solvent.

20. The parts washer of claim 19 and wherein said Filter cartridge mounting means includes an opening in the bottom wall of said sink of a breadth sufficient to pass the filter cartridge downwardly through the bottom wall of the sink.

21. The parts washer of claim 19, further including an external filter housing mounted externally of said sink and said reservoir, and wherein said pump and conduit means includes means for directing liquid solvent from said pump through said external filter housing to said faucet means, so that a cartridge filter can be placed in the external filter housing and the liquid solvent moved through and cleaned by the cartridge filter in the external filter housing.

22. The parts washer of claim 19, and further including stopper means for plugging the inlet of the filter cartridge received in the filter cartridge opening to block liquid solvent from moving through the filter cartridge.

23. The parts washer of claim 19, and further including means for plugging said filter cartridge opening in the bottom wall of said sink when said filter cartridge has not been placed in said opening so that the parts washer can be used to clean parts without a filter cartridge positioned in said opening.

24. The parts washer of claim 19, wherein said filter cartridge further comprises a drain passage having an inlet and outlet extending therethrough and a filter passage having an inlet and an outlet extending therethrough so that the liquid cleaning solvent can pass directly through the drain passage without filtration of the liquid cleaning solvent and can pass through the filter passage with filtration of the liquid cleaning solvent, and means for plugging at least one inlet of said drain passage and said filter passage.

25. The parts washer of claim 24, wherein said filter cartridge further comprises a paper filter disposed within said filter cartridge adapted and constructed to retain diatomaceous earth as a filter media for filtration of the liquid cleaning solvent.

26. A method for clarifying and reclaiming liquid cleaning solvent in a parts washer for cleaning mechanical parts with liquid cleaning solvent, said parts washer having a sink with bottom wall and side wail means supported upon a reservoir, comprising the steps of:

mounting a filter cartridge downwardly into an opening in the bottom wall of the sink;

passing the liquid cleaning solvent under pressure from the reservoir through flexible hose means to the sink;

connecting said hose means in sealed fluid communication with a filter passage opening defined in the filter cartridge;

passing liquid cleaning solvent at greater than atmospheric pressure from said hose means into and through said filter cartridge and back into the reservoir;

whereby the liquid cleaning solvent used in the parts washer is clarified and reclaimed for continued use in cleaning mechanical parts within the parts washer.

27. The method defined by claim 26, which further comprises the steps of:

passing pressurized liquid cleaning solvent from said conduit means through an external filter housing having a cartridge filter mounted thereon, said external filter housing and cartridge filter being in sealed fluid communication with said conduit means;

passing pressurized liquid cleaning solvent through said cartridge filter;

passing pressurized liquid cleaning solvent from said cartridge filter and external filter housing into the flexible hose means, whereby the liquid cleaning solvent is passed through said external filter housing and cartridge filter under pressure before it is passed under pressure through said filter cartridge provided within the bottom wall of said sink, for providing dual pressure filtration of the liquid cleaning solvent used in the parts washer.

28. The method as defined by claim 26, wherein said filter cartridge further comprises a drain passage defined therein, said drain passage having an inlet and an outlet extending through said filter cartridge, and a filter passage having an inlet and an outlet extending through said filter cartridge, and further comprising the step of passing the solvent directly through the drain passage without filtration of the solvent.

* * * * *